US008705321B2

(12) United States Patent
Akiyama et al.

(10) Patent No.: US 8,705,321 B2
(45) Date of Patent: Apr. 22, 2014

(54) ELECTRONIC TIMEPIECE AND TIME ADJUSTMENT METHOD FOR AN ELECTRONIC TIMEPIECE

(75) Inventors: Toshikazu Akiyama, Matsumoto (JP); Chen Wei Lin, Toronto (CA)

(73) Assignee: Seiko Epson Corporation, Tokyo (JP)

( * ) Notice: Subject to any disclaimer, the term of this patent is extended or adjusted under 35 U.S.C. 154(b) by 874 days.

(21) Appl. No.: 12/357,079

(22) Filed: Jan. 21, 2009

(65) Prior Publication Data

US 2009/0190444 A1 Jul. 30, 2009

(30) Foreign Application Priority Data

Jan. 29, 2008 (JP) ..... 2008-017442

(51) Int. Cl.
*G04C 11/00* (2006.01)

(52) U.S. Cl.
USPC ..... 368/21; 368/47

(58) Field of Classification Search
USPC ..... 368/14, 47, 21
See application file for complete search history.

(56) References Cited

U.S. PATENT DOCUMENTS

| | | | | |
|---|---|---|---|---|
| 5,627,547 | A * | 5/1997 | Ramaswamy et al. | 342/357.57 |
| 5,724,316 | A * | 3/1998 | Brunts | 368/10 |
| 5,964,821 | A * | 10/1999 | Brunts et al. | 701/201 |
| 6,278,660 | B1 * | 8/2001 | Tognazzini | 368/21 |
| 6,366,834 | B1 | 4/2002 | Hayes et al. | |
| 6,876,600 | B2 | 4/2005 | Ito et al. | |
| 7,965,937 | B2 * | 6/2011 | Nishikawa et al. | 396/310 |
| 2002/0136094 | A1 | 9/2002 | Kawai | |
| 2002/0191492 | A1 * | 12/2002 | Kamper et al. | 368/47 |
| 2009/0135675 | A1 | 5/2009 | Akiyama | |
| 2010/0057349 | A1 | 3/2010 | Akiyama | |

FOREIGN PATENT DOCUMENTS

| | | | |
|---|---|---|---|
| CN | 1407417 | A | 4/2003 |
| CN | 101017364 | A | 8/2007 |
| DE | 4222307 | A1 | 1/1994 |
| DE | 102005021002 | A1 | 11/2006 |
| EP | 1014235 | A2 | 6/2000 |
| JP | 2001-228271 | | 8/2001 |
| JP | 2001-337182 | | 12/2001 |
| JP | 2002-062383 | | 2/2002 |
| JP | 2003004457 | | 1/2003 |

(Continued)

OTHER PUBLICATIONS

Acquire—dictionary.com :: Jun. 7, 2012.*
Acquire—google.com :: Jun. 7, 2012.*

*Primary Examiner* — Sean Kayes

(57) ABSTRACT

An electronic timepiece includes a reception unit that receives satellite signals transmitted from positioning information satellites and acquires time information and positioning information, a time zone information storage unit that stores region data dividing geographical information containing time difference information into a plurality of regions, and time difference information contained in each region, a time difference information acquisition unit that extracts the region containing the positioning information acquired by the reception unit from the region data, and acquires the time difference information contained in that region, and a time calculation unit that calculates the current time based on the time difference information acquired by the time difference information acquisition unit and the time information acquired by the reception unit. The region data stored in the time zone information storage unit including region data dividing the geographical information into a plurality of regions, and region data further dividing each region that contains a plurality of time difference values into a plurality of regions.

6 Claims, 9 Drawing Sheets

(56) References Cited

FOREIGN PATENT DOCUMENTS

| | | |
|---|---|---|
| JP | 2003139875 | 5/2003 |
| JP | 2006-029960 | 2/2006 |
| JP | 2006-350887 | 12/2006 |
| JP | 2009-128296 | 6/2009 |
| JP | 2010-060455 | 3/2010 |
| WO | 2006117059 A2 | 11/2006 |

* cited by examiner 352 353

| REGION DATA | TIME ZONE INFORMATION |
|---|---|
| COORDINATE DATA 1 | LINK 1 |
| COORDINATE DATA 2 | LINK 2 |
| COORDINATE DATA 3 | LINK 3 |
| COORDINATE DATA 4 | TIME DIFFERENCE +8 |
| ... | ... |

35

FIG. 3

361 362 363

| LINK | REGION DATA | TIME ZONE INFORMATION |
|---|---|---|
| 2 | COORDINATE DATA 2-1 | TIME DIFFERENCE +7 |
| 2 | COORDINATE DATA 2-2 | TIME DIFFERENCE +9 |
| 2 | COORDINATE DATA 2-3 | TIME DIFFERENCE +9 |
| 2 | COORDINATE DATA 2-4 | TIME DIFFERENCE +9 |
| ... | ... | ... |
| 2 | COORDINATE DATA 2-16 | TIME DIFFERENCE +8 |

36

FIG. 4

352 353

| REGION DATA | TIME ZONE INFORMATION |
|---|---|
| COORDINATE DATA 1 | LINK 1 |
| COORDINATE DATA 2 | LINK 2 |
| COORDINATE DATA 3 | LINK 3 |
| COORDINATE DATA 4 | TIME DIFFERENCE +8 |
| ... | ... |

35

FIG. 9

361 362 363

| LINK | REGION DATA | TIME ZONE INFORMATION |
|---|---|---|
| 2 | COORDINATE DATA 2-1 | LINK 100 |
| 2 | COORDINATE DATA 2-2 | TIME DIFFERENCE +9 |
| 2 | COORDINATE DATA 2-3 | TIME DIFFERENCE +8 |
| 2 | COORDINATE DATA 2-4 | LINK 101 |

36

FIG.10

371 372 373

| LINK | REGION DATA | TIME ZONE INFORMATION |
|---|---|---|
| 100 | COORDINATE DATA 100-1 | TIME DIFFERENCE +7 |
| 100 | COORDINATE DATA 100-2 | TIME DIFFERENCE +9 |
| 100 | COORDINATE DATA 100-3 | TIME DIFFERENCE +7 |
| 100 | COORDINATE DATA 100-4 | TIME DIFFERENCE +9 |
| 101 | COORDINATE DATA 101-1 | TIME DIFFERENCE +9 |
| 101 | COORDINATE DATA 101-2 | TIME DIFFERENCE +9 |
| 101 | COORDINATE DATA 101-3 | TIME DIFFERENCE +9 |
| 101 | COORDINATE DATA 101-4 | TIME DIFFERENCE +8 |

37

FIG.11

ELECTRONIC TIMEPIECE AND TIME ADJUSTMENT METHOD FOR AN ELECTRONIC TIMEPIECE

CROSS-REFERENCE TO RELATED APPLICATIONS

Japanese Patent application No. 2008-017442 filed Jan. 29, 2008, is hereby incorporated by reference in its entirety.

BACKGROUND

1. Field of Invention

The present invention relates to an electronic timepiece and to a time adjustment method for an electronic timepiece that receives radio signals transmitted from positioning satellites such as GPS satellites and acquires the current date and time.

2. Description of Related Art

The Global Positioning System (GPS) for determining the position of a GPS receiver uses GPS satellites that circle the Earth on known orbits, and each GPS satellite has an atomic clock on board. Each GPS satellite therefore keeps the time (referred to below as the GPS time or satellite time information) with extremely high precision.

All GPS satellites transmit the same GPS time, and the Universal Coordinated Time (UTC) is acquired by adding the UTC offset to the GPS time. For an electronic timepiece to receive the satellite signal transmitted from a GPS satellite, acquire the GPS time, and display the local time (regional time) at the location where the electronic timepiece is being used, the time difference to the UTC must be added after correcting for the UTC offset in order to get the current local time, and the electronic timepiece must therefore know what this time difference is.

The UTC offset can be acquired from the data in the received satellite signal, or a predetermined value stored in ROM may be used.

Radio-controlled timepieces and navigation systems that use satellite signals transmitted from GPS satellites to acquire positioning information and time information (UTC), determine the time zone (time difference) of the current location from the acquired positioning information, and calculate and display the current local time are known from the literature. See, for example, Japanese Unexamined Patent Appl. Pub. JP-A-2003-139875 and Japanese Unexamined Patent Appl. Pub. JP-A-2003-4457.

Some problems with the foregoing related art are described below.

The technology taught in Japanese Unexamined Patent Appl. Pub. JP-A-2003-139875 extracts the fixed position information closest to the mobile device position by selecting a circular area centered on a particular fixed position and uses the time difference (time zone) for that fixed position if the position of the mobile device is in that area.

In order to adjust the size of these circular areas, distances are normalized using a weighting coefficient referred to as the fixed range information. However, when the time zone borders overlap and there are multiple fixed positions around and near the location of the mobile device, it is difficult to set the fixed ranges so that detection errors do not occur, and the amount of data that must be stored increases.

Furthermore, because the distance between the mobile device and each fixed position must be calculated, computation time increases when there are multiple fixed positions in the vicinity of the mobile device, the time difference (time zone) cannot be set quickly, and user convenience is thus impaired.

The technology taught in Japanese Unexamined Patent Appl. Pub. JP-A-2003-4457 relies on using map data stored on a CD-ROM, DVD, Or other medium, acquires the time zone information based on a massive amount of map data, and therefore cannot be used in devices, such as wristwatches, with limited memory capacity.

SUMMARY OF INVENTION

An electronic timepiece and a time adjustment method for an electronic timepiece according to the present invention enable quickly setting the time zone while reducing the require memory capacity and enabling application in wristwatches.

An electronic timepiece according to a first aspect of the invention includes a reception unit that receives satellite signals transmitted from positioning information satellites and acquires time information and positioning information, a time zone information storage unit that stores region data dividing geographical information containing time difference information into a plurality of regions, and time difference information contained in each region, a time difference information acquisition unit that extracts the region containing the positioning information acquired by the reception unit from the region data, and acquires the time difference information contained in that region, and a time calculation unit that calculates the current time based on the time difference information acquired by the time difference information acquisition unit and the time information acquired by the reception unit. The region data stored in the time zone information storage unit including region data dividing the geographical information into a plurality of regions, and region data further dividing each region that contains a plurality of time difference values into a plurality of regions.

This aspect of the invention stores data about the regions into which geographical information is divided in the region data.

This geographical information includes large regions having a single time zone, such as China and maritime regions, as well as regions where the time zones may overlap near national borders such as in Europe and the Middle East. The invention therefore divides such geographical information into regions of a predetermined size, and then further subdivides regions containing a plurality of time zones (time difference information) into smaller regions.

This aspect of the invention thus defines areas (regions) with a single large time zone as a regional area of a predetermined size (a large region), and further divides only those large regions that contain a plurality of time zones into subregions (small regions). The invention thus defines fewer regions and can define the regions using less region data than configurations in which all geographical information is divided into small regions. The invention can therefore be used in small devices with limited memory capacity, such as wristwatches.

If only large regions are defined, it may not be possible to acquire the correct time zone information even if the large region containing the acquired positioning information (current location) can be identified when multiple time zones are contained in a single large region, such as in areas where time zone borders overlap. In this situation the invention sets small areas further dividing the large regions into smaller units, and enables determining the small region in which the acquired positioning information is located. Because these small regions are smaller than the large regions, the small regions can be defined for a single time zone, and the correct time zone information can therefore be acquired.

Furthermore, because predetermined large regions and small regions are defined and time difference information for the time zone contained in each region is stored instead of storing border definitions for each time zone, the amount of data that must be stored can be reduced significantly compared with storing border definitions. The invention can therefore be used even in applications that do not have enough memory capacity to store border definitions. The invention can therefore be used in small electronic timepieces such as wristwatches.

Furthermore, because the time zone information can be acquired by simply determining the region in which the acquired positioning information is located, the time zone information can be acquired and set quickly compared with methods that calculate the distance between the acquired positioning information and specific fixed positions as described in Japanese Unexamined Patent Appl. Pub. JP-A-2003-139875.

The invention can thus reduce the required memory capacity, and thereby enable use in a wristwatch while also quickly setting the time zone (time difference).

Further preferably, the region data stored in the time zone information storage unit includes at least first region data dividing the geographical information into a plurality of first regions, and second region data dividing each first region that contains a plurality of time zones into a plurality of second regions.

This aspect of the invention sets the large regions as first regions and sets the small regions as second regions, and thus has the same effect as the aspect of the invention described above.

Yet further preferably, the region data also includes at least third region data dividing each second region that contains a plurality of time zones into a plurality of third regions.

This aspect of the invention stores third region data that subdivides the second regions, and thus enables setting regions in three different size levels from the first regions to third regions. The areas can thus be set more easily according to the size of a particular time zone region, and the required memory capacity can be further reduced.

The third regions may also be further divided into fourth regions as needed, such as when the time zone regions are particularly small, and the fourth regions may be yet further divided into fifth regions.

In another aspect of the invention the region data stores time difference data in the time difference information for a region that contains only one time zone, and stores a link to region data that subdivides the region in the time difference information for a region that contains a plurality of time zones.

If the acquired positioning information is contained in a region that contains a plurality of time zones, the data links enable retrieving only the region data into which the region that contains the acquired positioning information is divided, and thus enable quickly detecting the region identified by the positioning information.

Furthermore, because the relationships between the first region data (large region data) and second region data (small region data), and the relationships between the second region data (large region data) and third region data (small region data), are represented by the data links, all region data can managed independently, and the region data can be easily set and managed.

Yet further preferably, each region in the region data is a rectangular area.

Because the regions are rectangular in this aspect of the invention, each region can be identified by storing only the coordinates for the two diagonally opposite corners. The amount of region data that must be stored can thus be reduced.

Note that if the regions are rectangular and of a constant size, only the coordinates for one corner of each region are needed, and the amount of data stored can be further reduced.

Yet further, because the size of each region can be freely defined, the regions (such as first to third regions) in the region data can be sized appropriately, the number of regions that are registered in the region data can be reduced, and the amount of data stored can be yet further reduced.

Yet further, because the regions are rectangular, the process of determining the region in which the acquired positioning information is located can be executed quite simply.

Yet further preferably, the time difference information in the region data can be updated by a user input operation in another aspect of the invention.

Because the time zone information can thus be updated manually by the user, the user can easily correct the time difference when the time difference changes in a particular region, and the correct time can therefore be easily displayed.

Another aspect of the invention is a time adjustment method for an electronic timepiece that has a reception unit that receives satellite signals transmitted from positioning information satellites and acquires time information and positioning information, and a time zone information storage unit that stores region data dividing geographical information containing) time difference information into a plurality of regions, and time difference information contained in each region. The region data stored in the time zone information storage unit including region data dividing the geographical information into a plurality of regions of a predetermined size, and region data further dividing each region that contains a plurality of time difference values into a plurality of regions. The time adjustment method includes a reception step that receives satellite signals transmitted from positioning information satellites and acquires time information and positioning information; a time difference information acquisition step that extracts the region containing the positioning information acquired by the reception step from the region data, and acquires the time difference information contained in that region; and a time calculation unit that calculates the current time based on the time difference information acquired by the time difference information acquisition step and the time information acquired by the reception step.

This aspect of the invention has the same effect as the electronic timepiece of the invention. More specifically, this aspect of the invention reduces the required memory capacity, enables application in a wristwatch, improves user convenience, and can accurately set the time zone.

Further preferably, time difference data is stored in the time difference information for a region that contains only one time zone, and a link to region data that subdivides the region is stored in the time difference information for a region that contains a plurality of time zones. The time difference information acquisition step detects the region containing the positioning information acquired by the reception step in the region data dividing the geographical information into regions of a predetermined size, and acquires the time difference data if time difference data is stored in the time difference information of the detected region, and if link information is stored in the time difference information of the detected region, detects the region containing the positioning information and acquires the time difference data for the detected region.

If the acquired positioning information is located in a region that contains a plurality of time zones, this aspect of the invention enables referencing only the region data that subdivides that larger region based on the link information, and thus enables quickly detecting the region to which the positioning information applies.

BRIEF DESCRIPTION OF THE DRAWINGS

FIG. 3 shows an example of a first region table.

FIG. 4 shows an example of a second region table.

FIG. 9 shows an example of the first region table in a second embodiment of the invention.

FIG. 10 shows an example of the second region table in a second embodiment of the invention.

FIG. 11 shows an example of the third region table in a second embodiment of the invention.

DESCRIPTION OF THE PREFERRED EMBODIMENTS

Preferred embodiments of the present invention are described below with reference to the accompanying figures.

The embodiments described below are specific preferred embodiments of the present invention and certain technically preferred limitations are therefore also described, but the scope of the present invention is not limited to these embodiments or limitations unless specifically stated below.

Embodiment 1

Figure 1:
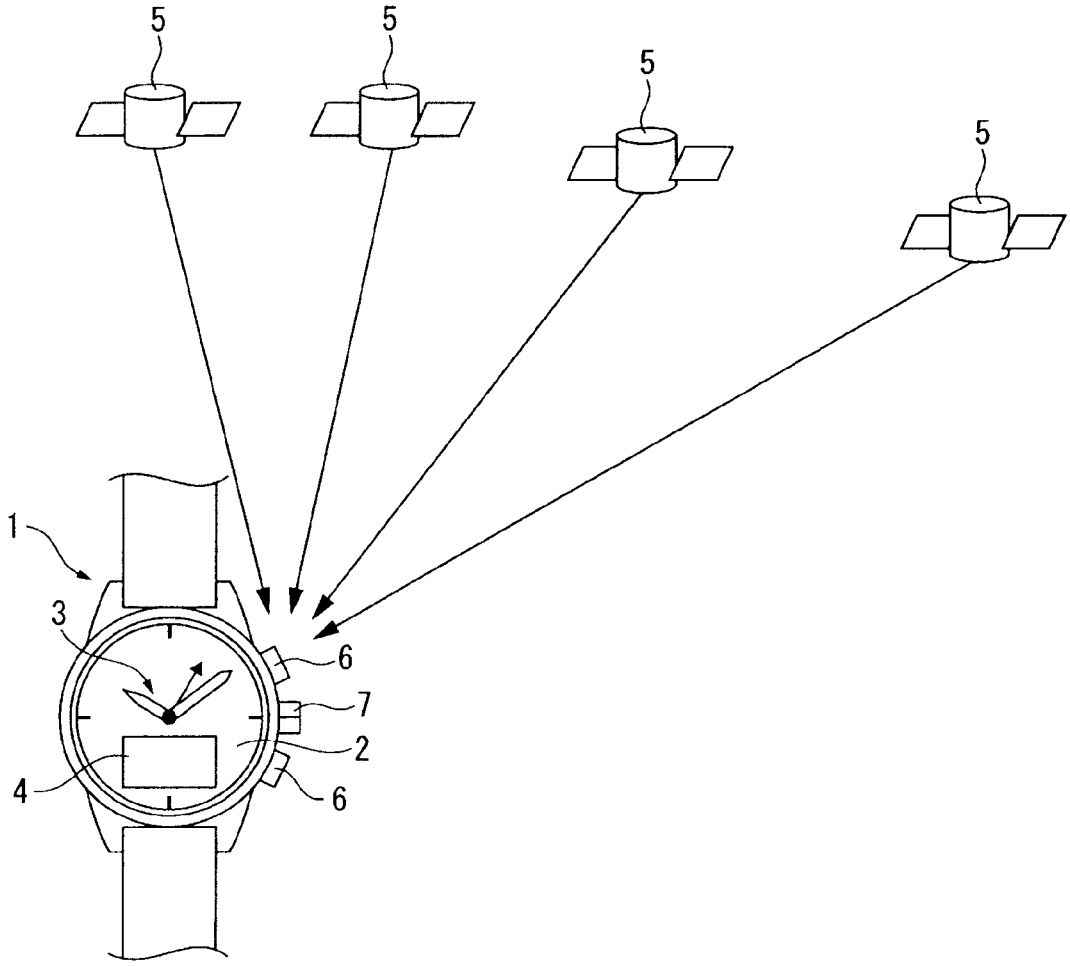
FIG. 1 is a schematic diagram showing a GPS wristwatch according to the present invention.
Figure 2:
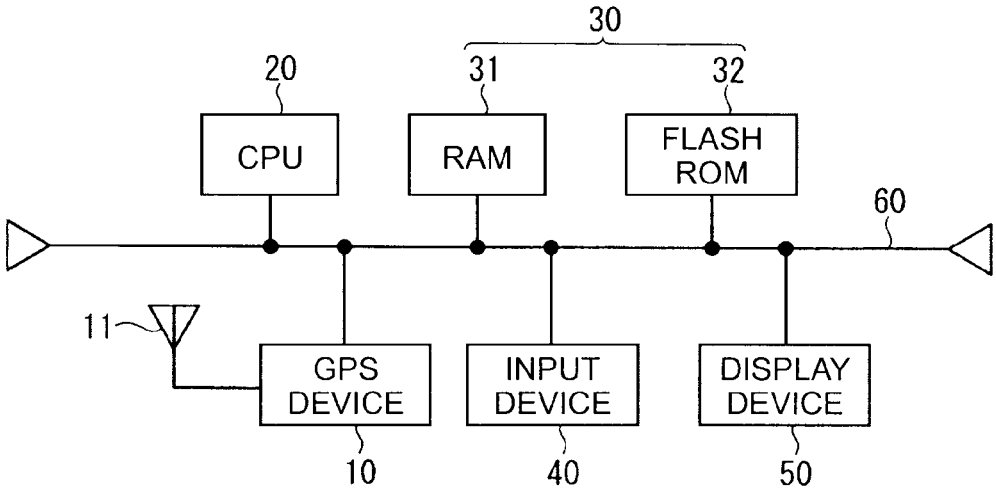
FIG. 2 schematically shows the basic circuit configuration of the GPS wristwatch.

FIG. 1 is a schematic diagram showing a wristwatch with a GPS satellite signal reception device 1 (referred to below as a GPS wristwatch 1) as an example of an electronic timepiece according to the present invention. FIG. 2 shows the main hardware configuration of the GPS wristwatch 1.

As shown in FIG. 1, the GPS wristwatch 1 has an analog display device including a dial 2 and hands 3. A window is formed in a part of the dial 2, and a display 4 (digital display device) such as an LCD panel is located in this window. The GPS wristwatch 1 is thus a combination timepiece having both hands 3 and a display 4.

The hands 3 include a second hand, minute hand, and hour hand, and are driven through a wheel train using a stepping motor.

The display 4 is typically a LCD unit and is used for displaying the current time and messages in addition to time zone information.

The GPS wristwatch 1 receives satellite signals from a plurality of GPS satellites 5 orbiting the Earth on fixed orbits in space and acquires satellite time information to adjust the internally kept time and positioning information, that is, the current location, on the display 4.

The GPS satellite 5 is an example of a positioning information satellite in the invention, and a plurality of GPS satellites 5 are orbiting the Earth in space. At present there are approximately 30 GPS satellites 5 in orbit.

The GPS wristwatch 1 has a crown 7 and buttons 6 as input devices (external operating members).

Circuit Design of the GPS Wristwatch

As shown in FIG. 2, the GPS wristwatch 1 has a GPS device 10 (GPS module), a control device 20 (CPU), a storage device 30, an input device 40, and a display device 50. The storage device 30 includes RAM 31 and flash ROM 32. Data is communicated between these different devices over a data bus 60.

The display device 50 includes the hands 3 and a display 4 for displaying the time and positioning information.

The GPS wristwatch 1 has an internal battery as the power source. The battery may be a primary battery or a rechargeable storage battery.

GPS Device

The GPS device 10 has a GPS antenna 11 and acquires time information and positioning information by processing satellite signals received through the GPS antenna 11.

The GPS antenna 11 is a patch antenna for receiving satellite signals from a plurality of GPS satellites 5 orbiting the Earth on fixed orbits in space. The GPS antenna 11 is located on the back side of the dial 12, and receives RF signals through the crystal and the dial 2 of the GPS wristwatch 1.

The dial 2 and crystal are therefore made from materials that pass RF signals, particularly the satellite signals transmitted from the GPS satellites 5. The dial 2, for example is plastic.

Although not shown in the figures, the GPS device 10 includes an RF (radio frequency) unit that receives and converts satellite signals transmitted from the GPS satellites 5 to digital signals, a baseband unit that correlates the reception signal and synchronizes with the satellite, and a data acquisition unit that acquires the time information and positioning information from the navigation message (satellite signal) demodulated by the baseband unit.

The RF unit includes a bandpass filter, a PLL circuit, an IF filter, a VCO (voltage controlled oscillator), an A/D converter, a mixer, a low noise amplifier, and an IF amplifier.

The satellite signal extracted by the bandpass filter is amplified by the low noise amplifier, mixed by the mixer with the signal from the VCO, and down-converted to an IF (intermediate frequency) signal. The IF signal mixed by the mixer passes the IF amplifier and IF filter, and is converted to a digital signal by the A/D converter.

The baseband unit includes a local code generator and a correlation unit. The local code generator generates a local C/A code (also referred to as a "local code" herein) that is identical to the C/A code used for transmission by the GPS satellite 5. The correlation unit calculates the correlation between this local code and the reception signal output from the RF unit.

If the correlation calculated by the correlation unit is greater than or equal to a predetermined threshold value, the local code and the C/A code used in the received satellite signal match, and the satellite signal can be captured (that is, the receiver can synchronize with the satellite signal). The navigation message can thus be demodulated by applying this correlation process to the received satellite signal using the local code.

The data acquisition unit gets the time information and positioning information from the navigation message demodulated by the baseband unit. More specifically, the navigation message transmitted from the GPS satellites 5 contains subframe data such as a preamble and the TOW (Time of Week, also called the Z count) carried in a HOW (handover) word. The subframe data is divided into five subframes, subframe 1 to subframe 5, and the subframe data includes the week number, satellite correction data including the satellite health, the ephemeris (detailed orbital information for each of the GPS satellites 5), and the almanac (approximate orbit information for all GPS satellites 5 in the constellation).

The data acquisition unit extracts a specific part of the data from the received navigation message, and acquires the time information and positioning information.

In addition to a program that is run by the control device 20, the time zone information shown in FIG. 3 and FIG. 4 is stored in flash ROM 32 in the storage device 30.

An area for storing the time information and positioning information acquired from the received satellite signals, and a time zone storage area for storing the time zone information read from the flash ROM 32, are reserved in the RAM 31 of the storage device 30.

The time zone area information stored in the flash ROM 32 includes a first region table 35 and second region table 36 as shown in FIG. 3 and FIG. 4. Because the flash ROM 32 is rewritable, the data in the region tables 35 and 36 can also be updated.

The first region table 35 stores region data 352 describing each of the first regions into which the geographic information is segmented, and time zone information 353 for the time zone contained in each first region. Note that this geographical information is map information containing time zone (time difference) information.

The second region table 36 contains a key link 361 denoting related first region, region data 362 for each of the second regions into which the first region is divided, and the time zone 363 of each second region.

Figure 5:
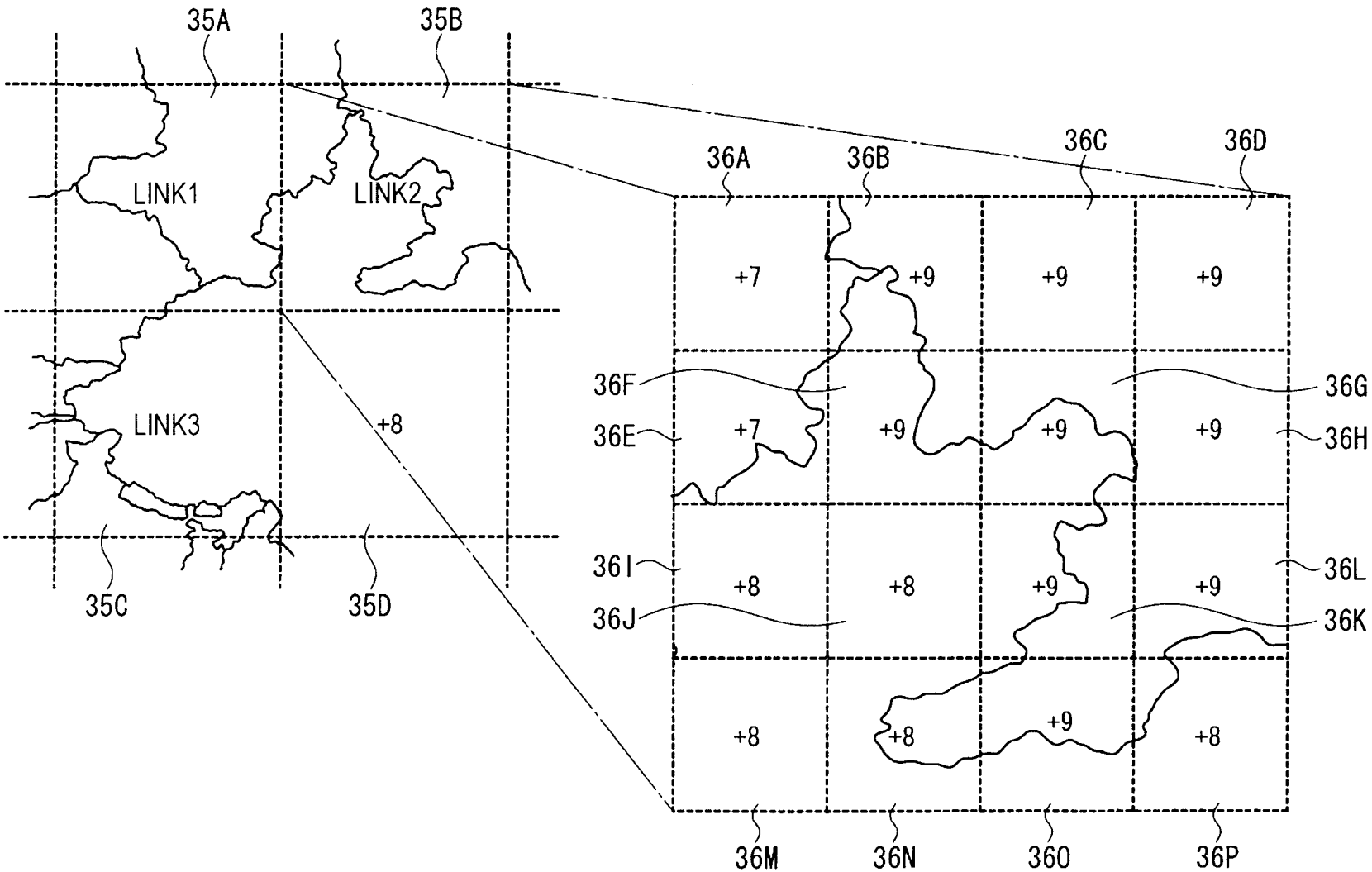
FIG. 5 shows an example of geographical information for which time zone data is set.

As shown in FIG. 5, the first regions and second regions in this embodiment of the invention are rectangular areas. Each of the first regions is a rectangular area from 1000 to 2000 km long in both east-west and north-south directions.

Coordinate values identifying each first region are stored in the region data 352 field of the first region table 35. More specifically, each region can be identified by the coordinates (longitude and latitude values) for the top left and bottom right corners of the region, and the coordinates for these two points are stored in the region data 352 field.

The time zone of each first region is stored in the time zone information 353 of the first region table 35. If a first region contains a plurality of time zones, that first region is subdivided into a plurality of subregions and the time zone information 353 for that first region stores a link to the second region table 3(6 storing information about these subregions. For example, of the four first regions 35A to 35D shown on the left side in FIG. 5, three first regions 35A to 35C each contain a plurality of time zones, and Link1 to Link3, which are the key links to the second region table 36, are stored in the time zone information 353 field of the first region table 35 for first regions 35A to 35C.

The other first region 35D contains only one time zone, and the time zone information 353 field for this first region 35D therefore stores the time difference to UTC, or +8 hours in this example.

The second regions are formed by dividing the first regions 35A to 35C each containing a plurality of time zones into a plurality of smaller regions. The number (size) of the second regions may be set, according to the time zones in the first region. For example, as shown on the right side in FIG. 5, the first region 35B is divided into 16 second regions 36A to 36P in this embodiment of the invention. Each of the second regions 36A to 36P is thus a square of 250-500 km per side.

Coordinate data for identifying each of the second regions 36A to 36P, such as the coordinates (longitude and latitude) of the top left and bottom right corners of each area, are thus stored in the region data 362 field of the second region table 36.

The time difference information for each second regions 36A to 36P (specifically the time difference to UTC) is stored in the time zone 363 field of the second region table 36. More specifically, second regions 36A and 36E are set to a time difference of +7 hours, second regions 36I, 36J, 36M, 36N, 36P are set to a +8 hour time difference, and second regions 36B, 36C, 36D, 36F, 36G, 36H, 36K, 36L, and 36O are set to a +9 hour time difference.

It will thus be obvious that when the first regions and second regions are compared, the first regions are larger in area than the second regions, and the second regions are smaller areas than the first regions.

Figure 6:
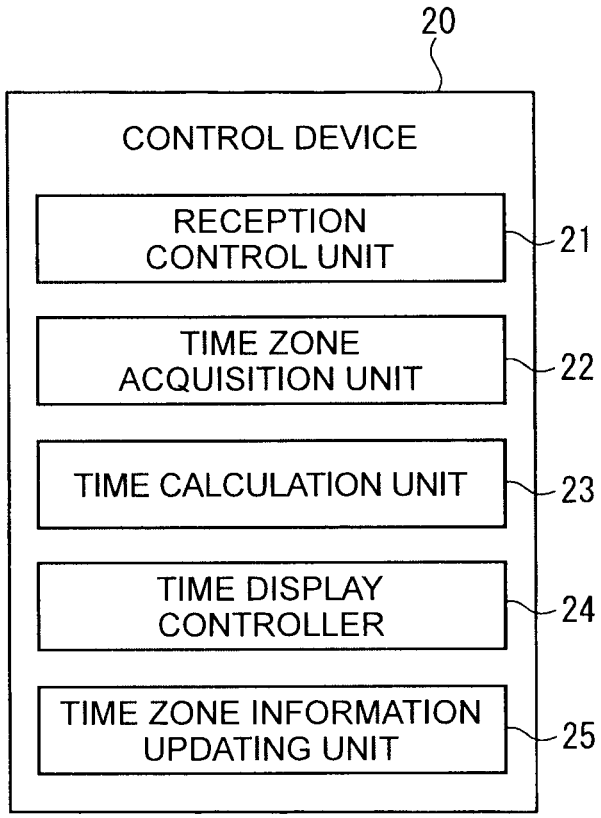
FIG. 6 is a block diagram showing the configuration of the control device.

The control device 20 (CPU) controls operation by running a program stored in the flash ROM 32. As shown in FIG. 6, the control device 20 includes a reception control unit 21, a time zone acquisition unit 22, a time calculation unit 23, a time display controller 24, and a time zone information updating unit 25.

When the reception control unit 21 detects from a signal input from the input device 40 that a button 6, the crown 7, or other input device 40 was operated to start reception, the reception control unit 21 controls driving the GPS device 10 to receive and process a satellite signal.

The time zone acquisition unit 22 then acquires the time difference information from the first region table 35 or second region table 36 based on the current position information (longitude and latitude) acquired by the GPS device 10.

The time calculation unit 23 then calculates the current time at the current location (the local time) based on the time information acquired by the GPS device 10 and the time difference acquired by the time zone acquisition unit 22.

The time display controller 24 normally controls driving the hands 3 of the display device 50 and displaying the time based on the internal time kept by a reference signal output from an oscillation circuit. The time display controller 24 can also control driving the display 4 of the display device 50 to digitally display the time.

When the local time is calculated by the time calculation unit 23, the time display controller 24 adjusts and displays the internal time using the calculated local time. The adjusted internal time is thereafter updated using the reference signal.

The time zone information updating unit 25 controls updating the time zone information in the region tables 35 and 36 when an external operating member such as a button 6 or crown 7 is operated in a predetermined way.

As described above, the display device 50 is rendered by the hands 3 or display 4, and is controlled by the time display controller 24.

The hands 3 are driven by a stepping motor and wheel train, and display the internal time, which is adjusted based on the received time data. The display 4 can display different kinds of information, including the time and the position.

Time Information Reception Process

The reception operation of the GPS wristwatch 1 is described next with reference to the flow chart in FIG. 7.

Figure 7:
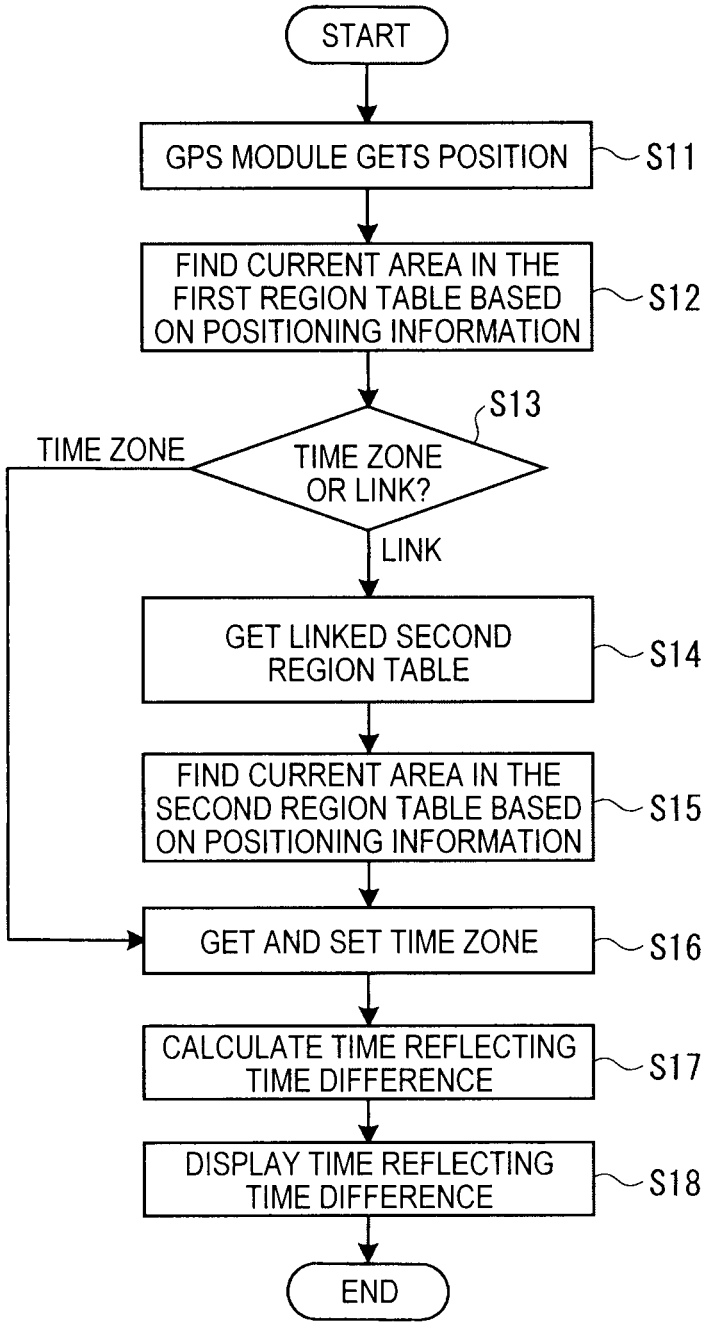
FIG. 7 is a flow chart showing the reception process in the first embodiment of the invention.

The reception process shown in FIG. 7 is run when the user initiates reception. More specifically, in order to acquire the positioning information used to determine the current position, ephemeris data containing detailed orbit information for the GPS satellites 5 must be received from four satellites. Acquiring the ephemeris for four GPS satellites 5 requires approximately 60 seconds, and power consumption therefore rises accordingly. As a result, the reception process is preferably executed when correcting the time displayed by the GPS wristwatch 1, such as when it is necessary for the user to receive the positioning information after travelling to a different country or returning home from a foreign country.

When reception starts the reception control unit 21 of the control device 20 drives the GPS device 10 (GPS module) to get the positioning information (S11). The time information is also acquired in S11 because the time information is acquired simultaneously to acquiring the positioning information.

The time zone acquisition unit 22 searches the first region table 35 based on the acquired positioning information to find the first region containing the location identified by the positioning information (coordinates) (S12).

For example, because the region data 352 stores the coordinates for the top left corner and the coordinates for the bottom right corner of the first regions, the first region containing the acquired positioning information can be determined by comparing the longitude and latitude of the acquired positioning information with the region data 352 for each region.

The time zone acquisition unit 22 then references the retrieved time zone information 353 for the first region, and determines whether time zone information 353 contains the time difference or a link (S13).

If a link is stored (S13: link) the time zone acquisition unit 22 uses the link to acquire the linked second region table 36 (S14).

The time zone acquisition unit 22 then searches the linked second region table 36 based on the acquired positioning information, and outputs the second region containing the positioning (coordinates) (S15).

The time zone acquisition unit 22 reads the first region time zone information 353 if the time difference was detected in S13, and reads the time zone 363 of the second region if the second region was found in S15, acquires the time difference for the acquired positioning information, stores the time difference in the time zone storage area in RAM 31, and sets the time zone (S16).

The time calculation unit 23 adds the UTC offset and the time difference to the received GPS time, and calculates the time reflecting the time difference (S17).

More specifically, because the same time as UTC (Coordinated Universal Time) is acquired by correcting the GPS time using the UTC offset, the current time at the current location can be calculated by adding the time difference to UTC.

For example, if the time difference to UTC is +9 hours, the time calculation unit 23 sets +9 as the time difference to UTC, and adds 9 hours to the UTC, that is, the GPS time+UTC offset, to get the current local time. If, for example, GPS time+UTC offset=UTC is 1:10, the time calculation unit 23 adds 9 hours to get the local time of 10:10.

Because the time difference information is stored in RAM 31 as described above, when only the time information is next received from the GPS satellite 5, the time calculation unit 23 adds the time difference stored in RAM 31 to the acquired time information to calculate the current local time (local time).

The time display controller 24 then displays the time calculated by the time calculation unit 23, that is, the current time reflecting the time difference to GPS time, using the display device 50 (S18).

More specifically, the time display controller 24 drives the stepping motor to quickly move the hands 3 to the positions indicating the calculated time. The selected region information and the calculated time may also be displayed on the display 4.

This completes the reception process for adjusting the displayed time to the time at the current location.

Time Information Reception Process and Time Zone Setting Process

Operation when the user adjusts the time zone information 353 and 363 stored in the region tables 35 and 36 to display the current local time is described next.

Figure 8:
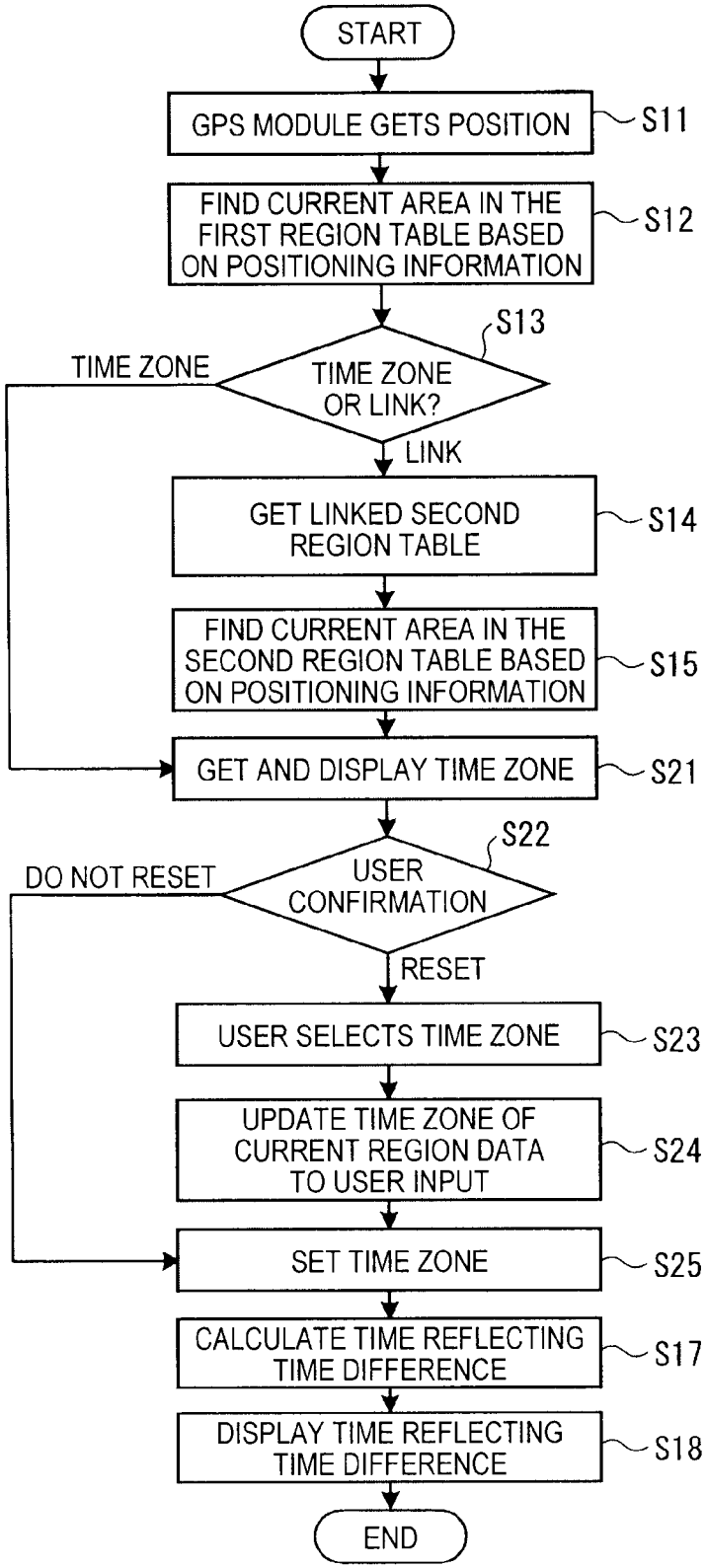
FIG. 8 is a flow chart showing the reception process in the time zone updating mode in the first embodiment of the invention.

More specifically, the flow chart shown in FIG. 8 shows the process that is executed when the user operates an external operating member such as a button 6 or the crown 7 to enter the time zone update mode and receive the satellite signal. Note that like steps in FIG. 7 and FIG. 8 are identified by the same reference numerals, and further description thereof is omitted below.

Referring to FIG. 8, when the user starts reception the reception control unit 21 drives the GPS device 10 (GPS module) to (get the positioning information and time information (S11).

The time zone acquisition unit 22 then searches the first region table 35 based on the acquired positioning information to find the corresponding first region (S12), and then determines whether time zone information 353 field contains the time difference or a link (S13).

If step S13 determines that a link is stored, the time zone acquisition unit 22 accesses the linked second region table 36 (S14), and then searches the second region table 36 based on the acquired positioning information to detect the corresponding second region (S15).

The time zone acquisition unit 22 reads the first region time zone information 353 if the time difference was detected in S13, and reads the time zone 363 of the detected second region if the second region was found in S15, acquires the time difference for the acquired positioning information, and displays the time difference on the display 4 (S21). Note that if there is no display 4, the second hand, for example, may be moved to display the time difference.

The time zone information updating unit 25 then detects if the user executes an operation confirming the time difference displayed on the display 4, and determines if the displayed time difference may be reflected in the displayed time (S22).

If it is determined in S22 that the displayed time difference should not be applied to the displayed time (S22: NG) the time zone information updating unit 25 continues to detect user operations selecting the time difference (S23).

For example, if pressing one of the buttons 6 changes the time zone displayed on the display 4+1 hour and pressing the other button 6 changes the time zone −1 hour, the time zone information updating unit 25 determines which button 6 is pressed after the operation rejecting applying the selected time difference, and changes the time difference displayed on the display 4 based on how many times the button 6 was pressed.

If the time zone information updating unit 25 detects that the time zone updating operation ended because a button 6 was not operated for 10 seconds, for example, it updates the time zone information stored in the time zone information 353, 363 in the region data 352, 362 corresponding to the acquired positioning information to the time zone selected by the user (S24).

The time zone information updating unit 25 then stores the time zone information updated in S24 in the time zone storage area in RAM 31, and sets the time difference (time zone) (S25).

If the user confirms in S22 that the displayed time zone may be reflected in the displayed time, the time zone information updating unit 25 stores the time zone information acquired in S21 in the time zone storage area in RAM 31 and sets the time zone (S25).

The time calculation unit 23 then adds the UTC offset and time difference information to the received GPS time to calculate the time reflecting the selected time difference (time zone) (S17).

The time display controller 24 then displays the time calculated by the time calculation unit 23, that is, the current time reflecting the time difference to GPS time, using the display device 50 (S18).

This process thus enables the user to update the time difference (time zone) at the acquired current location and display the correct time.

Effect of the First Embodiment (1) The GPS wristwatch 1 according to this embodiment of the invention has two levels of region data tables, a first region table 35 storing the first regions of a predetermined size into which map information is divided, and a second region table 36 storing the second regions into which each first region containing a plurality of time zones is subdivided. Large regions having a single time zone, such as ocean areas and China, are thus divided into large first regions, and regions containing time zone borders, such as national borders, can be divided into second regions that are smaller than the first regions.

Compared with dividing all of the map information into the second regions, the method of the invention reduces the number of set regions, and accordingly reduces the amount of region data to be stored. As a result, the invention can be used in devices such as wristwatches with limited memory capacity.

Furthermore, if ill of the map information is divided into first regions, and at single first region contains a plurality of time zones, such in areas where the time zone borders overlap, it may not be possible to determine the correct time zone information even if the first region containing the acquired positioning information (current location) can be accurately identified. The invention prevents this problem, however, by further subdividing such first regions into smaller second regions so that which second region contains the acquired positioning information can be accurately determined. In addition, because the second regions are smaller in area than the first regions, the second regions can be defined for each time zone, and the possibility of correctly determining the local time zone can be improved.

The invention can therefore reduce the require data storage capacity, enabling use even in wristwatches, and enables accurately setting the time zone (time difference) because the correct time zone (time difference) information can be acquired.

(2) The GPS wristwatch 1 receives satellite signals from the GPS satellites 5 and acquires positioning information for the GPS wristwatch 1, and automatically acquires the time zone information from the first region table 35 and second region table 36 based on the positioning information.

As a result, when the reception process runs, time zone information for the current location can be automatically acquired and the displayed time can be changed to the current local time. The user therefore does not need to adjust the time displayed on the timepiece, and user convenience can be improved.

More particularly, because satellite signals from GPS satellites 5 can be received throughout the world, the area in which the invention can be used is larger than that of radio-controlled timepieces, which adjust the time by receiving long-wave standard time signals that are limited to specific geographical areas, and user convenience can be improved accordingly.

(3) Furthermore, because a key link to the second region table 36 is stored in the first region table 35 in the time zone information 353 of a first region containing a plurality of time zones, the time zone acquisition unit 22 can first search the first region table 35 when the positioning information is acquired, and then automatically search the second region table 36 if a link is found in the time zone information 353 field.

The time zone acquisition unit 22 therefore does not need to compare the acquired positioning information with all region data in each of the region tables 35 and 36, and can thus quickly identify the correct region. More specifically, because the regions that are stored in the first region table 35 are large, the region data to be searched is small, and the first region containing the acquired positioning information can be quickly detected. In addition, because only the linked second regions are retrieved from the second region table 36, the corresponding regions can be quickly detected. The load on the CPU can thus be reduced and the CPU can operate in a low power mode, and the energy efficiency of the GPS wristwatch 1 can be improved.

(4) By defining the first regions and second regions as rectangular regions, the regions registered in the region tables 35 and 36 can be identified using only the coordinates for two diagonally opposite corners of each rectangular region, and the amount of data stored in the region tables 35 and 36 can thus be reduced.

In addition, because the sizes of the first regions and second regions can be set freely as needed, one first region 35B can be divided into 16 second regions while another first region 35A is divided into only four parts to define the second regions contained therein, for example. The first regions can also be set to larger areas in North and South America, for example. Each of the first regions and second regions can therefore be appropriately sized, thus reducing the number of regions registered in the region tables 35 and 36 accordingly, and further reducing the amount of data to be stored.

(5) Furthermore, because each of the first regions and second regions is rectangular, the process for determining the region in which the acquired positioning information is located is extremely simple. As a result, the time difference (time zone) can be detected more quickly, the load on the CPU can be further reduced, and power efficiency can be further improved compared with methods in which the time difference (time zone) is determined by calculating the distance between the acquired positioning information (location) and a fixed point to which a time difference (time zone) value is assigned.

(6) Furthermore, by providing a time zone information updating unit 25 and enabling the user to manually update the time difference (time zone) of the region corresponding to the acquired positioning information, the correct current local time can be immediately reset and displayed if the time difference of the region changes.

Embodiment 2

A second embodiment of the invention is described next with reference to FIG. 9 to FIG. 12. Note that in the embodiments described below parts that are the same or similar to parts in another embodiment are identified by the same reference numeral and further description thereof is omitted or simplified.

This second embodiment of the invention has a third region table 37 in addition to the first region table 35 and second region table 36, and divides the time zone regions in three levels.

The first region table 35 and the second region table 36 are the same as described above in the first embodiment.

The third region table 37 is similar in structure to the second region table 36, and stores a key link 371 relating the third region to a second region, region data 372 indicating the area of each third region into which the second region is divided, and the time zone (time difference) 373 in the corresponding third region.

As in the first embodiment, the first regions in this embodiment of the invention include first regions 35A to 35D, and a link to a second region table 36 is stored in the time zone information 353 field of first regions 35A to 35C.

The first region 35B is also divided into four second regions 36A to 36D. A link to the third region table 37 is stored in the time zone 363 field of second regions 36A and 36D. The time difference of +9 and +8 hours, respectively, is recorded in the time zone 363 field of second regions 36B and 36C.

The second region 36A is divided into four third regions 37A to 37D. The second region 36D is divided into four third regions 37E to 37H.

The corresponding time difference value is stored in the time zone 373 field of each of the third regions 37A to 37H as shown in FIG. 11.

Comparing the first regions and second regions, the first regions are thus larger areas than the second regions, and the second regions are smaller areas than the first regions. Comparing the second regions and the third regions, the second regions are larger areas than the third regions, and the third regions are smaller areas than the second regions.

Comparing the first, second, and third regions, it will thus be obvious that the first regions are largest, the second regions are mid-size regions, and the third regions are the smallest areas.

The hardware configuration of the GPS wristwatch 1 according to this second embodiment of the invention is the same as that of the first embodiment shown in FIG. 2 and FIG. 6, and further description thereof is thus omitted below.

Figure 13:
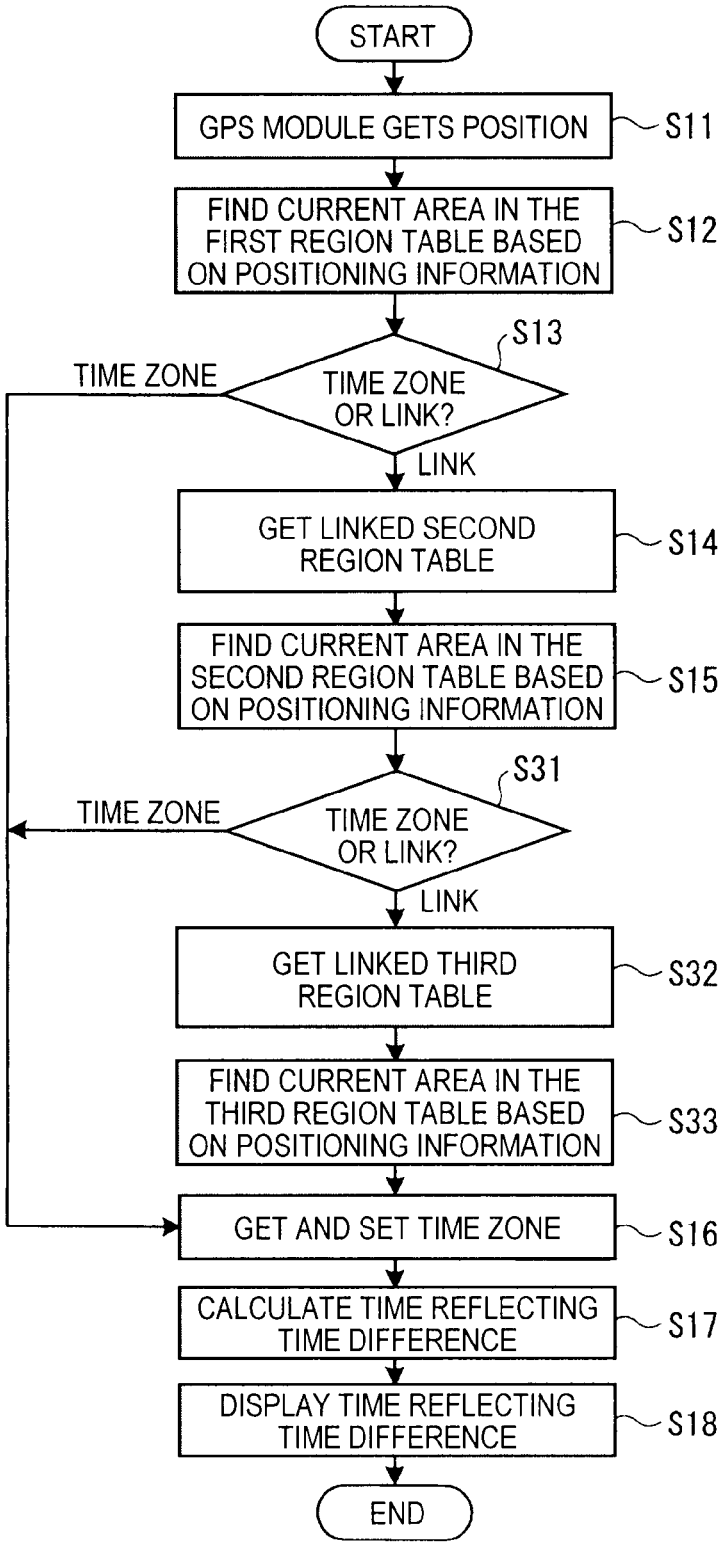
FIG. 13 is a flow chart showing the reception process in the second embodiment of the invention.

The second embodiment of the invention executes a reception process as described by the flow chart in FIG. 13. Identical steps in the flow chart in FIG. 13 and the flow chart of the first embodiment described above are identified by the same reference numerals, and further description thereof is simplified below.

When the reception process is started, the reception control unit 21 drives the GPS device 10 (GPS module) to get the positioning information and time information (S11).

The time zone acquisition unit 22 then searches the first region table 35 based on the acquired positioning information to find the corresponding first region (S12), and then determines whether time zone information 353 field contains the time difference or a link (S13).

If step S13 determines that a link is stored, the time zone acquisition unit 22 accesses the linked second region table 36 (S14), and then searches the second region table 36 based on the acquired positioning information to detect the corresponding second region (S15).

The time zone acquisition unit 22 then determines whether time zone information 363 field of the detected second region contains the time difference or a link (S31).

If step S31 determines that a link is stored, the time zone acquisition unit 22 accesses the linked third region table 37 (S32), and then searches the third region table 37 based on the acquired positioning information to detect the corresponding third region (S33).

The time zone acquisition unit 22 reads the first region time zone information 353 if the time difference was detected in S13, reads the time zone 363 of the corresponding second region if the time difference information is detected in S31, and reads the time zone 373 of the detected third region if a third region was found in S33, acquires the time difference for the acquired positioning information, and stores and sets the time difference in RAM 31 (S16).

The time calculation unit 23 then adds the UTC offset and time difference information to the received GPS time to calculate the time reflecting the selected time difference (time zone) (S17).

The time display controller 24 then displays the calculated time using the display device 50 (S18).

Effect of the Second Embodiment

The second embodiment of the invention has the same effect as the first embodiment of the invention.

In addition, by using region tables 35 to 37 and dividing the time zone regions in three levels, each region can be sized appropriately according to each time zone, the amount of region data to be stored can be reduced, and the required memory capacity can be reduced.

Figure 12:
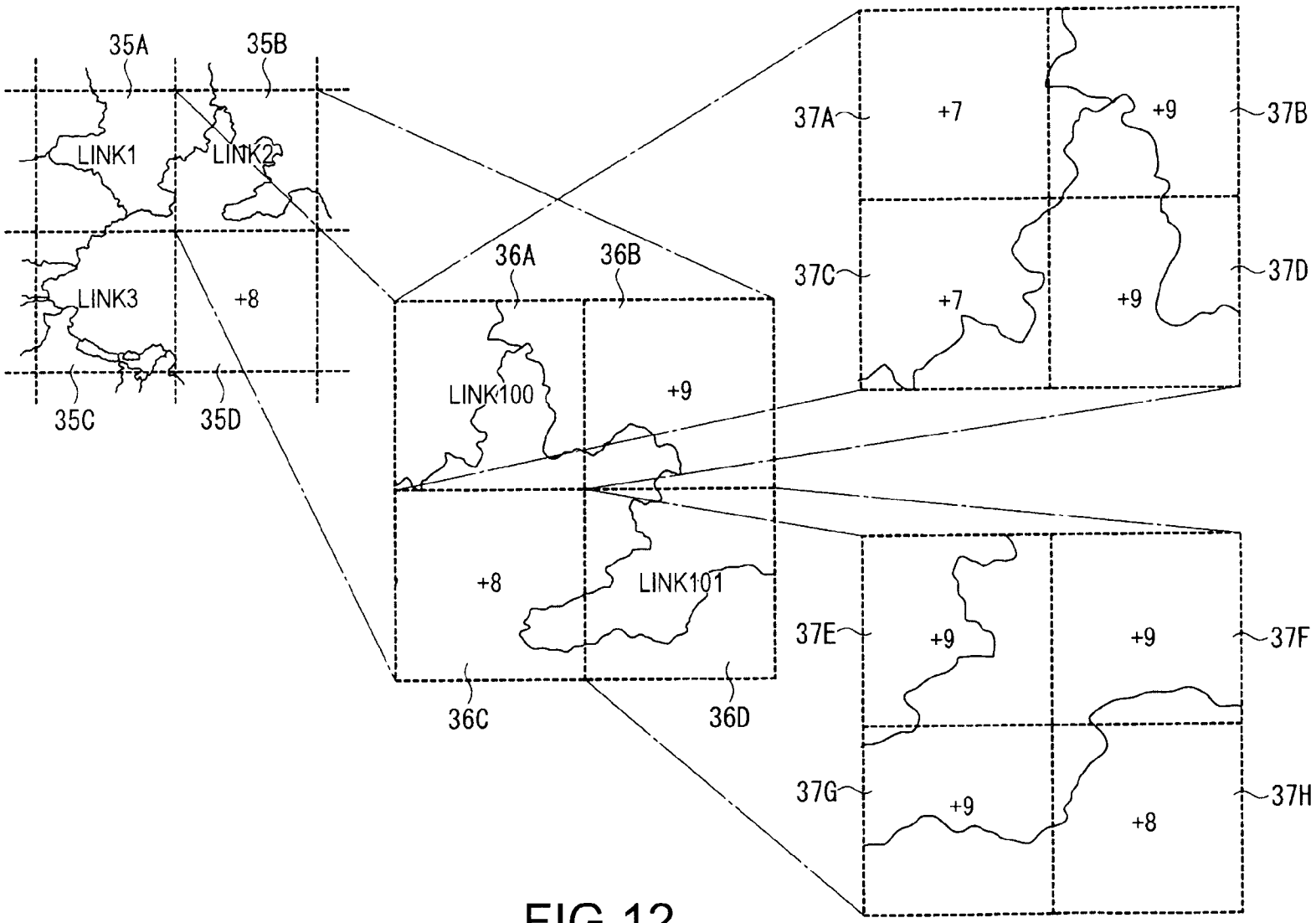
FIG. 12 shows an example of geographical information for which time zone data is set in a second embodiment of the invention.

For example, the first embodiment requires data for 20 regions, including first regions 35A to 35D and second regions 36A to 36P. As shown in FIG. 12, however, this second embodiment requires data for only 16 first to third regions total, and can thus reduce the amount of required data. Less memory is therefore needed to store this data, and the invention can be easily used in a small GPS wristwatch 1.

Variations

The invention is not limited to the embodiments of the invention described above.

For example, the regions into which geographical information is divided are rectangular in the embodiments described above, but the invention is not limited to rectangular regions and other shapes may be used, including triangular, trapezoidal, or polygons with protruding or recessed portions. However, rectangular regions are beneficial because they can be defined using the coordinates for only two points, and can be easily compared with the received positioning information.

Furthermore, while the rectangular areas are defined using the coordinates for two points in the foregoing embodiments, the areas may alternatively be defined using the coordinates for one point, such as the top left corner of the rectangular area, and the size of the rectangular area, such as the length of a diagonal line from this top left corner to the opposite corner.

Further alternatively, if the size of each rectangular area used in each level is fixed, each region can be defined using the coordinates for only one point.

Yet further, the rectangular regions are defined by longitude lines and latitude lines in the foregoing embodiments, but shapes not defined by longitude lines or longitude lines may be used instead. For example, rectangular regions defined by lines inclined 45 degrees to the longitude lines and latitude lines may be used.

All of the first regions are also not limited to being the same size, and the first regions may be sized according to the time zones in a particular region. In maritime zones such as the Pacific Ocean and Atlantic Ocean, for example, and in regions where a single time zone covers a large geographical region, such as in China, the size of the first regions set in those areas can be increased accordingly.

The number of second regions into which the first regions are divided, and the number of third regions into which the second regions are divided, are also not limited to the foregoing embodiments, and the number of divisions may be set appropriately according to the time zones in each region. For example, the first region 35B is divided into 16 second regions in the first embodiment above, but the first region 35A may be divided into four second regions and first region 35C may be divided into nine second regions.

The third regions subdividing the second regions may also be sized so that plural time zones are not present in any single third region. The number of third regions into which each second region is subdivided may also be adjusted in each second region.

The first embodiment described above has a function enabling the user to update the time zone information stored in flash ROM 32, and a similar function may also be disposed in the second embodiment.

Each of the foregoing embodiments is also configured to reference the second region table 36 or third region table 37 using key links, but the method of referencing information for the regional subdivisions is not so limited. For example, the data stored in region tables 35 to 37 may be stored in a single table, and the region data for the first regions to third regions may be referenced based on the acquired positioning information to find the corresponding region.

However, if key links are used, separate region tables 35 to 37 may be provided to simplify data management.

Furthermore, the first embodiment defines regions in two levels using first and second regions, and the second embodiment defines regions in three levels using first to third regions, but the regions may be defined using four or more levels. More specifically, if a large region contains a plurality of time zones, the process of subdividing that region may be repeated a plurality of times to define each region. The number of levels into which the regions are divided may be adjusted until the size of region yielding no regions containing a plurality of time zones is found.

Yet further, the specific size of each region is not limited to the foregoing embodiments, and the regions may be sized appropriately to the application. The length of one side of each first region may be set to 100 km and the length of one side of each second region may be set to 20 km, for example.

The first and second embodiments described above relate to a combination timepiece, but may also be applied to a digital timepiece that does not have hands.

The electronic timepiece according to the present invention described above is also not limited to wristwatches, and can be widely applied to pocket watches and other portable electronic timepieces that are used mobilely.

The invention is also not limited to electronic timepieces as described above, and can be used with various other types of electronic devices with other functions in addition to a timekeeping function. The invention may, for example, be used with cell phones that have a GPS function and a timepiece function, navigation devices, and other electronic devices.

The foregoing embodiments are described with reference to a GPS satellite, but the invention is not limited to GPS satellites and can be used with Global Navigation Satellite Systems (GNSS) such as Galileo and GLONASS, and other positioning information satellites that transmit satellite signals containing time information, including the SBAS and other geostationary or quasi-zenith satellites.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An electronic timepiece comprising:

a GPS device that receives satellite signals transmitted from positioning information satellites and acquires time information and orbit information and determines current position;

a time zone information storage unit that stores region data dividing geographical information containing time difference information into a plurality of regions, and time difference information contained in each region;

a time difference information acquisition unit that extracts the region containing the current position determined by the GPS device from the region data, and acquires the time difference information contained in that region; and a time calculation unit that calculates a current time based on the time difference information acquired by the time difference information acquisition unit and the time information acquired by the GPS device;

the region data stored in the time zone information storage unit including first region data dividing the geographical information into a plurality of first regions, and second region data further dividing each first region that contains a plurality of time difference values into a plurality of second regions;

the first region data including time difference data for first regions that contain only one time zone and including a link to the second region data for first regions that contain a plurality of time zones;

the time difference information acquisition unit extracting a first region containing the current position from the first region data and, if there is time difference data associated with the extracted first region, acquiring the time difference information for the extracted first region from the first region data, and if there is a link to the second region data associated with the extracted first region, acquiring the time difference information for the extracted first region from the second region data based on the link.

2. The electronic timepiece described in claim 1, wherein: the region data also includes at least third region data dividing each second region that contains a plurality of time zones into a plurality of third regions.

3. The electronic timepiece described in claim 1, wherein: each region in the region data is identified by coordinates for top left and bottom right corners of the region.

4. The electronic timepiece described in claim 1, wherein: the time difference information in the region data can be updated by a user input operation.

5. The electronic timepiece described in claim 1, wherein: the current position contains longitude and latitude information.

6. A time adjustment method for an electronic timepiece that has a GPS device that receives satellite signals transmitted from positioning information satellites and acquires time information and orbit information, and a time zone information storage unit that stores region data dividing geographical information containing time difference information into a plurality of regions, and time difference information contained in each region, the region data stored in the time zone information storage unit including first region data dividing the geographical information into a plurality of first regions of a predetermined size, and second region data further dividing each first region that contains a plurality of time difference values into a plurality of second regions, the time adjustment method comprising:

a reception step that receives satellite signals transmitted from positioning information satellites and acquires time information and positioning information and determines current position;

a time difference information acquisition step that extracts the region containing the current position determined by the reception step from the region data, and acquires the time difference information contained in that region; and a time calculation step that calculates a current time based on the time difference information acquired by the time difference information acquisition step and the time information acquired by the reception step;

wherein the time difference information acquisition step comprises extracting a first region containing the current position from the first region data and, if there is time difference data associated with the extracted first region, acquiring the time difference information for the extracted first region from the first region data, and if there is a link to the second region data associated with the extracted first region, acquiring the time difference information for the extracted first region from the second region data based on the link.

* * * * *